US006062822A

United States Patent [19]

Nathan

[11] Patent Number: 6,062,822

[45] Date of Patent: May 16, 2000

[54] HIGH-PRESSURE CLEANING APPARATUS

[75] Inventor: Robert Nathan, Backnang, Germany

[73] Assignee: Alfred Karcher GmbH & Co., Winnenden, Germany

[21] Appl. No.: 09/010,710

[22] Filed: Jan. 22, 1998

Related U.S. Application Data

[63] Continuation of application No. PCT/EP96/03327, Jul. 29, 1996.

[30] Foreign Application Priority Data

Jul. 29, 1995 [DE] Germany ..... 195 27 854

[51] Int. Cl.[7] ..... F04B 49/00

[52] U.S. Cl. ..... 417/43; 200/81 R

[58] Field of Search ..... 417/36, 38, 43, 417/63; 137/505.41; 200/81 R

[56] References Cited

U.S. PATENT DOCUMENTS

| | | | |
|---|---|---|---|
| 3,563,671 | 2/1971 | Weber | 417/38 |
| 3,739,810 | 6/1973 | Horan, Jr. | 137/568 |
| 3,782,858 | 1/1974 | Deters | 417/26 |
| 3,973,877 | 8/1976 | Taki | 417/38 |
| 4,247,260 | 1/1981 | Schönwald et al. | 417/38 |

FOREIGN PATENT DOCUMENTS

| | | |
|---|---|---|
| 18 06 598 | 5/1970 | Germany . |
| 42 21 286 | 1/1993 | Germany . |

*Primary Examiner*—Henry C. Yuen
*Assistant Examiner*—Mahmoud M. Gimie
*Attorney, Agent, or Firm*—Barry R. Lipsitz; Ralph F. Hoppin

[57] ABSTRACT

In a high-pressure cleaning apparatus comprising an electric motor, a high-pressure pump driven by the electric motor, and an automatic switching-off means for the electric motor including a switch actuatable by an actuating element moveable in dependence upon the pressure or the flow of the liquid being conveyed by the high-pressure pump, in order to reduce the switching expenditure it is proposed that a switching-off element which is manually actuatable on the high-pressure cleaning apparatus be associated with the same switch so that in one position of the switching-off element, the switch cuts off the power supply to the electric motor independently of the pressure or the flow of the liquid being conveyed, whereas in the other position the switch is actuatable by the actuating element.

24 Claims, 5 Drawing Sheets

Figure 1:
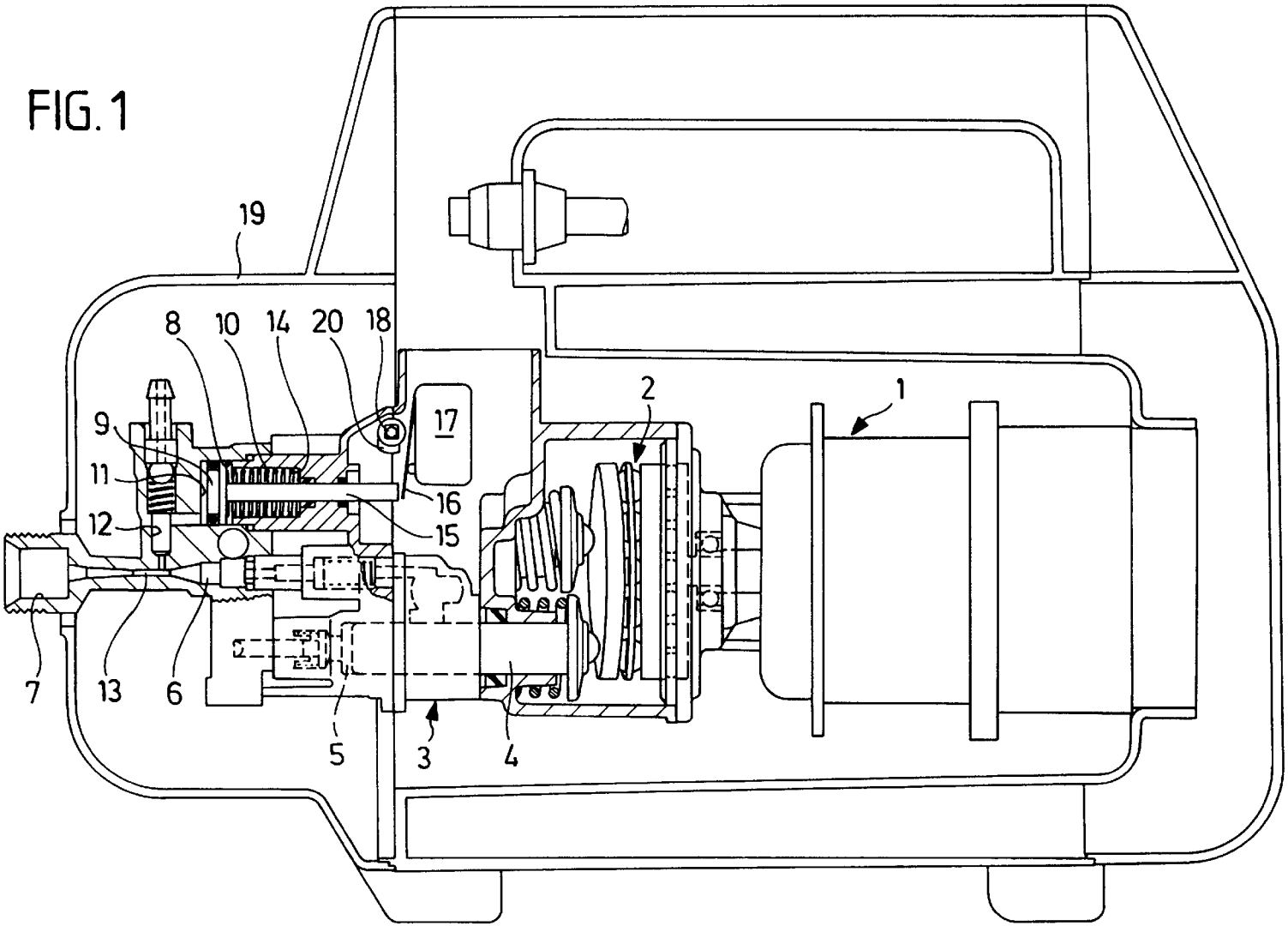

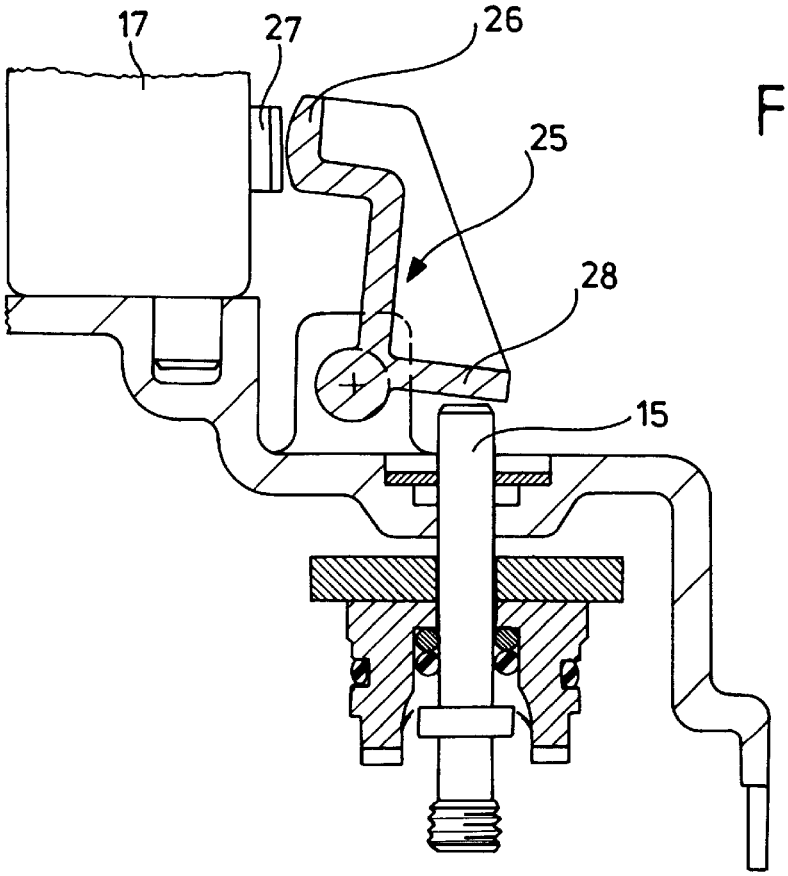
FIG. 5
FIG. 6
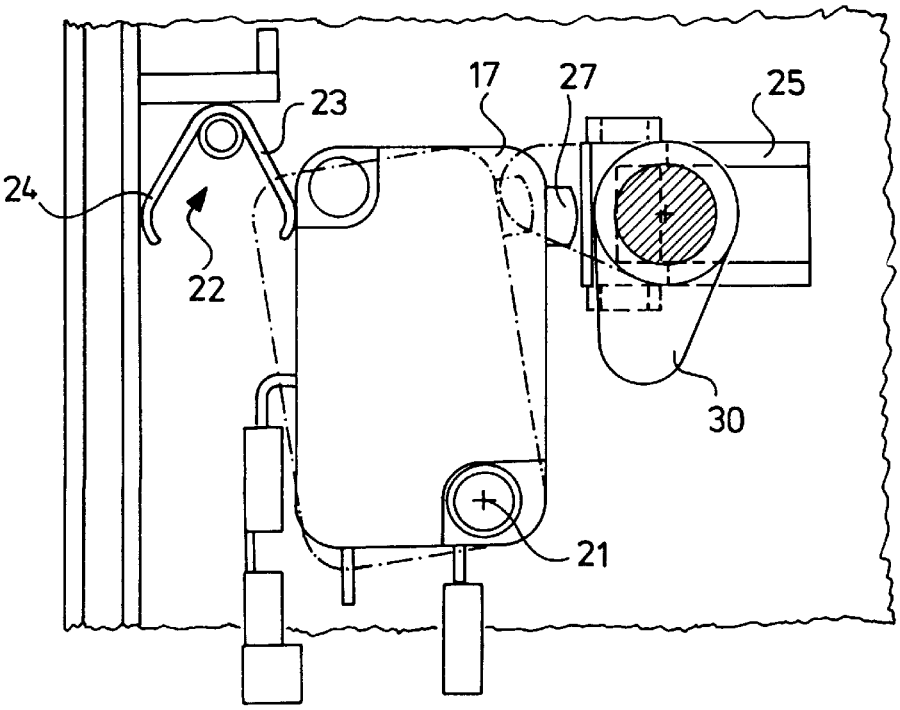

HIGH-PRESSURE CLEANING APPARATUS

The present disclosure relates to the subject matter disclosed in international application PCT/EP96/03327 of Jul. 29, 1996, the entire specification of which is incorporated herein by reference.

The invention relates to a high-pressure cleaning apparatus comprising an electric motor, a high-pressure pump driven by the electric motor, and an automatic switching-off means for the electric motor including a switch actuatable by an actuating element moveable in dependence upon the pressure or the flow of the liquid conveyed by the high-pressure pump.

Such a high-pressure pump is described in, for example, DE 42 21 286 A1. The previously known switching-off device comprises a slidingly mounted plunger which acts upon a microswitch and actuates it such that the power supply to the electric motor is cut off when certain pressure or flow conditions prevail, for example, when the delivery of liquid is prevented by closure of the delivery line or when insufficient liquid is supplied by the pump. There are various pressure or flow sensors here for monitoring the desired operating conditions and initiating actuation of such emergency stop switches. DE 42 21 286 A1 describes provision of a sensor element which is directly placed in the discharge line for detecting any excess pressure upstream in the line and thereby initiating a switching-off. In this construction, the microswitch used as emergency stop switch is connected in series to the main switch of the high-pressure cleaning apparatus. Therefore, an additional main switch is required for the normal switching-off of the apparatus.

The object of the invention is to so design a high-pressure cleaning apparatus of the generic kind that the switching operations mentioned hereinabove can be carried out with less expenditure.

This object is accomplished in accordance with the invention in a high-pressure cleaning apparatus of the kind described at the outset in that a switching-off element which is manually actuatable on the high-pressure cleaning apparatus is associated with the same switch so that in one position of the switching-off element the switch cuts off the power supply to the electric motor independently of the pressure or the flow of the liquid being conveyed, whereas in the other position it is actuatable by the actuating element.

Accordingly, the emergency stop switch in the novel construction is also used directly as main switch so it is no longer necessary to provide separate switches for these functions. This common switch acting as both emergency stop switch and main stop switch continues to be actuated by the mechanical actuating element which is moved in dependence upon flow or pressure and may initiate an emergency stop if maximum values are exceeded. A switching-off element also acts additionally on the same switch and can move the same switch to the switched-off position, namely independently of the respective position of the actuating element. Therefore, the apparatus can be switched off at any time by this switching-off element, and a special switch is no longer required therefor.

In principle, it is possible for the switching-off element to act directly on the actuating element and to displace it independently of the pressure and flow values. However, a construction wherein both the actuating element and the switching-off element are moveable against a displaceable switch element of the switch and wherein the switch element is thereby moved to the switched-off position of the switch is advantageous. The actuating element and the switching-off element are, therefore, parallel switching elements which can alternatively move the switch to the switched-off position. In normal operation both actuating element and switching-off element are so removed from the switch that the switch is not switched off. Once the maximum values of pressure or flow of the liquid are exceeded, the actuating element is moved against the switch and switches it off. If the switching-off element is actuated, it acts in the same way on the switch.

In a preferred embodiment provision may be made for the switching-off element to be fixable in the switched-off position, for example, by detention of the switching-off element. It is thereby ensured that this intentionally set position is maintained, i.e., the apparatus remains switched off when the switching-off element is moved to the switched-off position.

In another preferred embodiment provision is made for the switching-off element to move the switch between two positions and for the actuating element to reach the switch for actuation thereof in only one of these two positions. Accordingly, the switch is moved by the switching-off element so far that the actuating element cannot further actuate the switch. Only when the switch is made to approach the actuating element by the switching-off element is actuation of the switch by the actuating element possible at all. When the switch is not actuated, the motor is off. Only upon actuation of the switch does the motor run.

Herein it is particularly advantageous for the switch to be mounted for swivel movement on the high-pressure cleaning apparatus and for the switching-off element to swivel the switch between two positions.

Here provision may be made for the switch to be pressed by a spring against the actuating element.

It is expedient for the switching-off element to be a rotatable eccentric device.

In a further preferred embodiment provision is made for the actuating element to be a swivel lever which rests against a switch projection of the switch and which can be swivelled by a plunger which is displaceable in dependence upon the pressure or the flow of the liquid being conveyed. A deflection of the movement of the plunger is thus possible, for example, the displacement of the switch member of the switch can take place transversely to the displacement of the plunger.

In a further preferred embodiment provision is made for the actuating element to carry a switch surface positionable on the switch member of the switch and to be displaceable in dependence upon the pressure or the flow of the liquid being conveyed such that in one position the switch surface actuates the switch member and in another not, and for the actuating element to be additionally displaceable by hand such that the switch surface is positionable on the switch member in one position only. Accordingly, for permanent switching-off the switch member itself is moved to a position in which the switch surface of the switch member is unable to reach the switch and so a switching operation cannot take place even upon displacement of the actuating element under the influence of the pressure or the flow of the cleaning liquid.

Herein it is particularly advantageous for the actuating element to be rotatable about an axis of rotation and displaceable along the axis of rotation in dependence upon the pressure or the flow of the cleaning liquid, and for it to carry at its outer circumference a switch surface which extends over only a limited circumferential angle and whose distance from the axis of rotation varies in the axial direction.

In one angular position of the actuating element, the switch surface can actuate the switch member of the switch by axial displacement of the actuating element, in another angular position, however, the switch surface cannot be positioned on the switch member of the switch, namely independently of the respective axial position of the actuating element.

For axial displacement of the actuating element it is expedient for a plunger which is displaceable in dependence upon pressure or flow of the cleaning liquid to rest thereagainst.

In a preferred embodiment provision is made for the actuating element to be connected in a rotationally fixed and axially freely displaceable manner to a switching-off element in the form of a rotatable member.

A particularly preferred embodiment is characterized in that the actuating element is in the form of a sleeve into which there projects a pin of the switching-off element, in that a plunger displaceable in dependence upon pressure or flow of the cleaning liquid rests against the bottom of the sleeve, and in that there is arranged between the switching-off element and the sleeve a spring which presses the sleeve against the plunger. This results in a very compact structural unit comprising actuating element and switching-off element.

Figure 2:
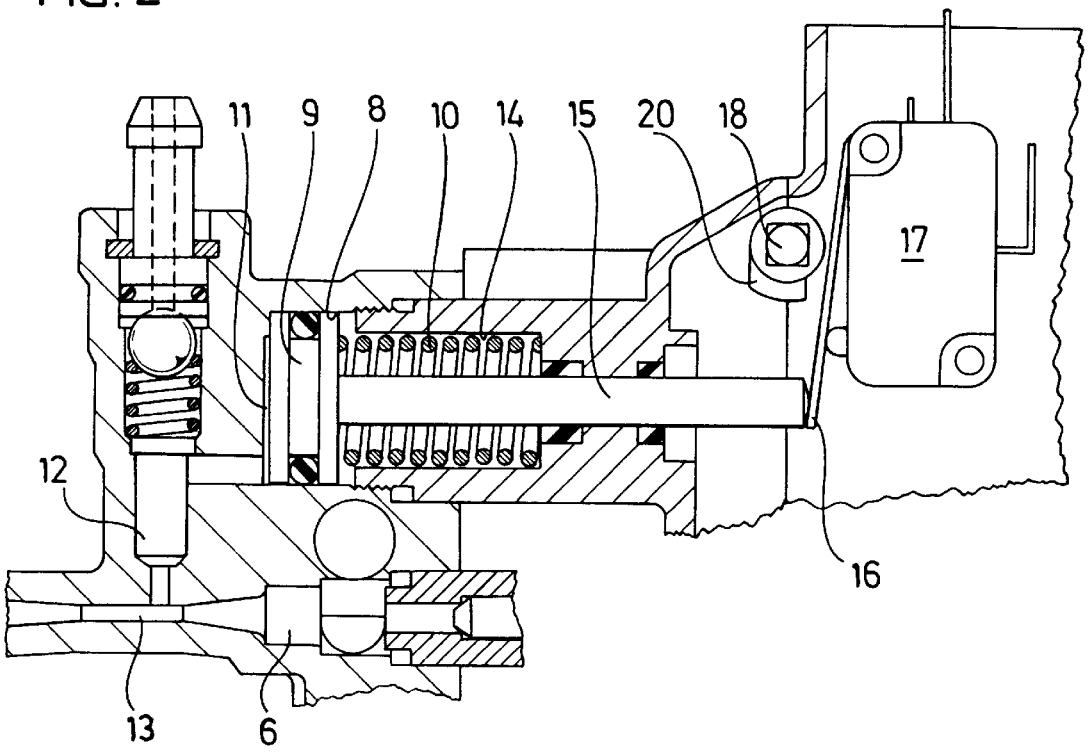
Figure 3:
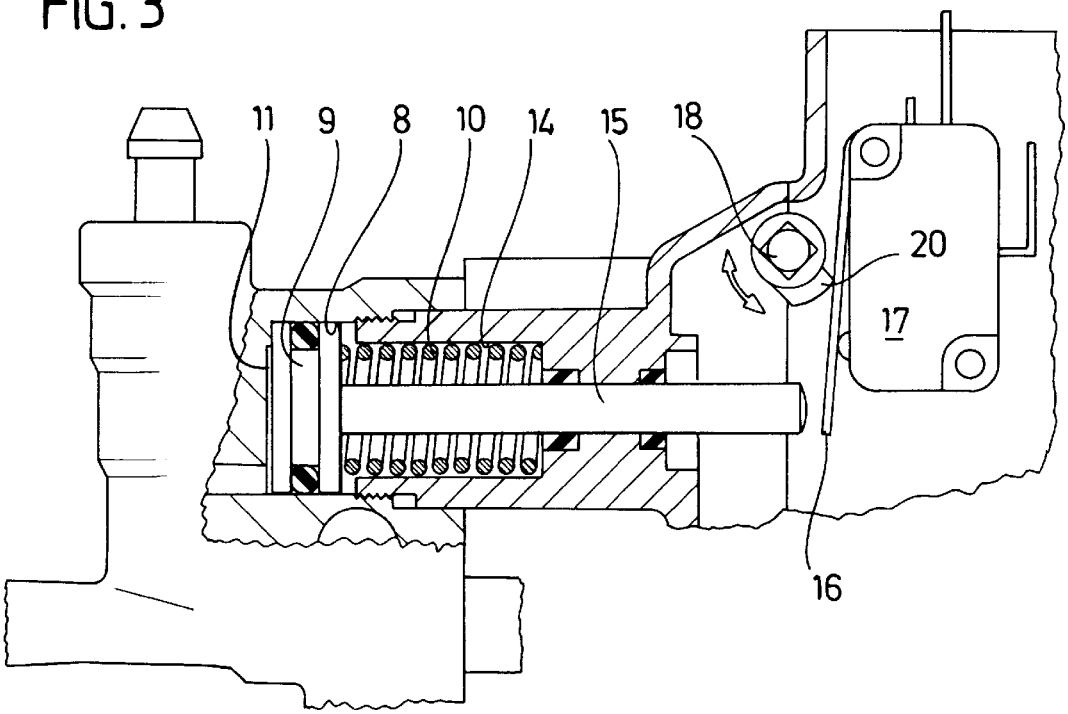
Figure 4:
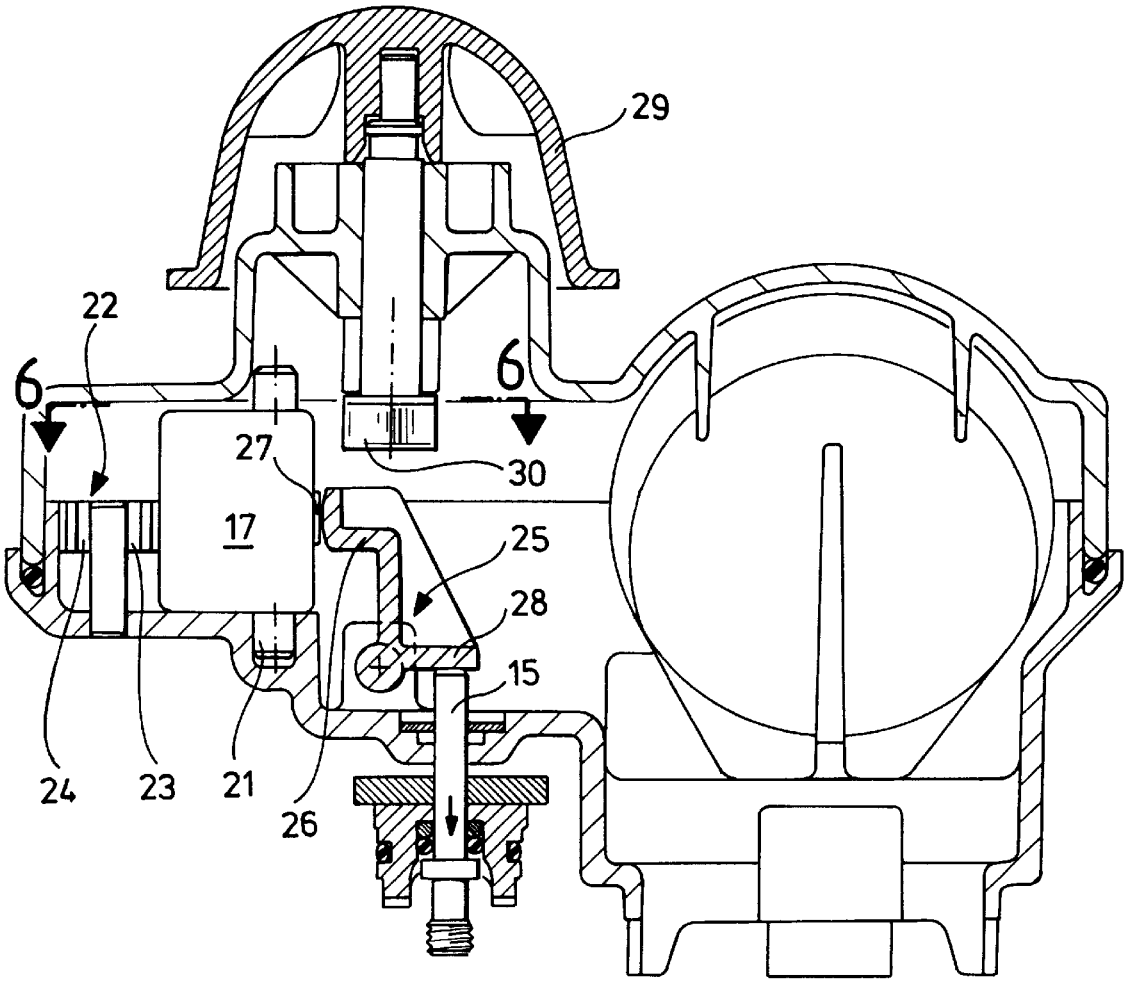
Figure 7:
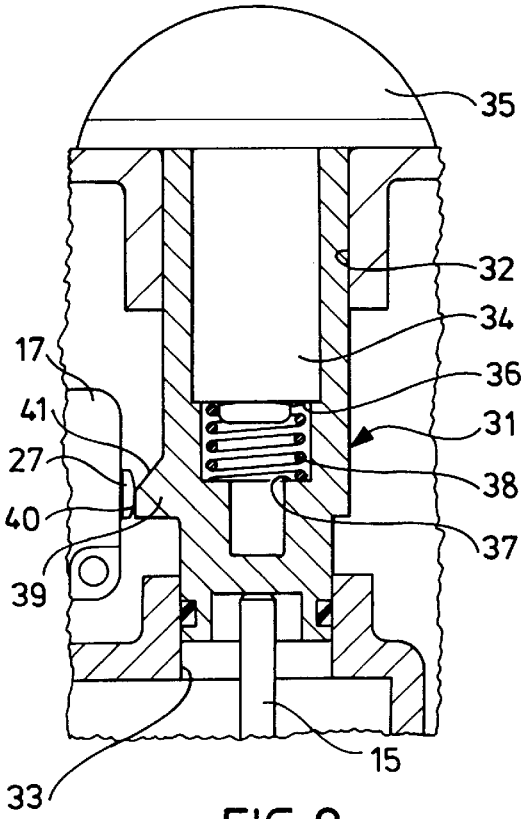
Figure 8:
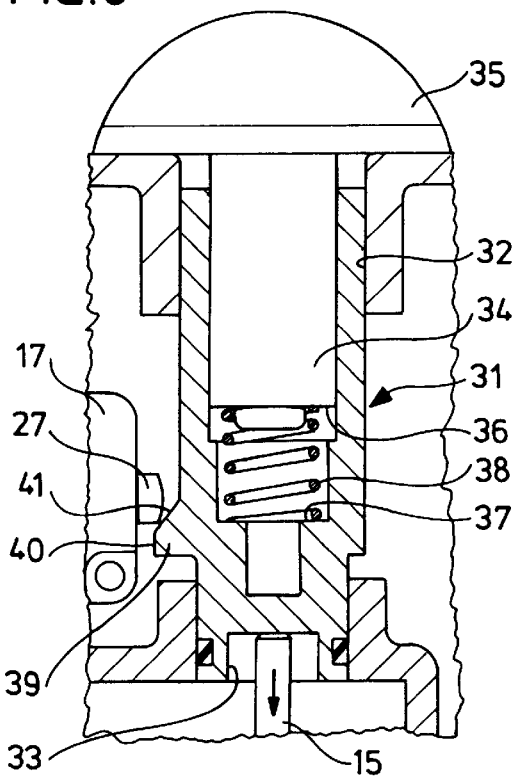

The following description of preferred embodiments of the invention serves for more detailed explanation in conjunction with the drawings, which show:

FIG. 1 a schematic view in longitudinal section through a high-pressure cleaning apparatus with a microswitch which is actuatable both by a flow-dependent actuating element and by an externally actuatable switching-off element;

FIG. 2 an enlarged detailed view of the microswitch, the actuating element and the switching-off element during normal operation of the high-pressure cleaning apparatus;

FIG. 3 a view similar to FIG. 2 with the switching-off element in the switched-off position;

FIG. 4 a schematic view in cross section of a high-pressure cleaning apparatus with a switch which is actuated by an actuating element and swivelled by a switching-off element;

FIG. 5 a partial view of the high-pressure cleaning apparatus of FIG. 4 in the area of the switch and the plunger actuating it when the switch is unactuated;

FIG. 6 a view in section along line 6—6 in FIG. 4 with the switch in the switched-on position (solid lines) and in the switched-off position (dot-and-dash lines);

FIG. 7 a view in longitudinal section of a combined actuating and switching-off element for the switch of a high-pressure cleaning apparatus in another preferred embodiment with the switch actuated;

FIG. 8 a view similar to FIG. 7 with the switch unactuated; and

Figure 9:
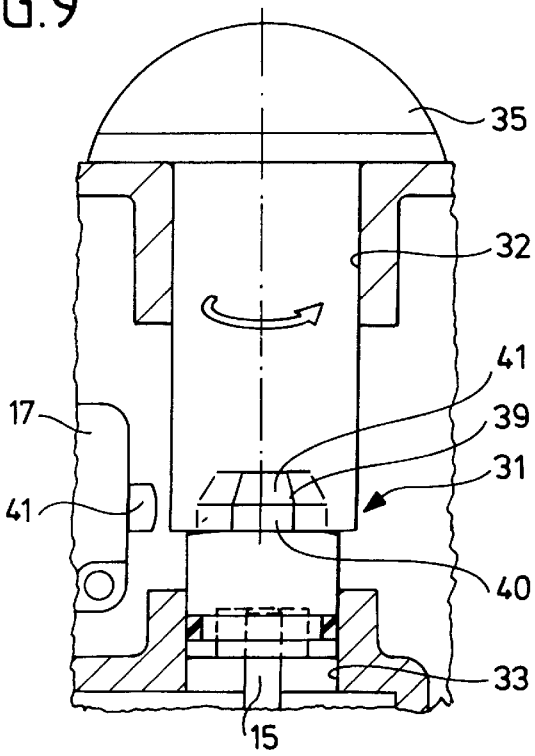

FIG. 9 a view similar to FIG. 7 with the actuating element switched off.

FIG. 1 shows a high-pressure cleaning apparatus essentially comprising an electric motor 1, a swash-plate drive 2 driven by the electric motor 1, and an axial piston pump 3 driven by the swash-plate drive 2. The pistons 4 of the axial piston pump 3 are pressed by springs against the swash-plate drive 2 and reciprocatingly moved by the swash-plate drive 2 in pump chambers 5.

Cleaning liquid drawn in by the axial piston pump 3 is conveyed through a pressure line 6 exiting from the axial piston pump 3 and delivered via a connection 7 to which, for example, a high-pressure hose with a high-pressure pipe can be connected. These parts are not illustrated in the drawings.

A piston 9 is displaceably mounted in a sealed-off manner in a separate control chamber 8 of the axial piston pump. The piston 9 is acted upon by a spring 10 arranged in the control chamber 8.

The piston 9 separates the control chamber 8 into two chambers, namely a first chamber 11, which is connected via a control line 12 to an injector-type constriction 13 of the pressure line 6, and a chamber 14, which, in a manner not clearly apparent from the drawings, is connected to the pressure line 6 upstream from the constriction 13. Therefore, the pressures in the chambers 11 and 14 are those which prevail in the area of the constriction 13 and in the area of the pressure line 6 located upstream, respectively.

The piston 9 is provided with a plunger 15 which is guided in a sealed-off manner out of the control chamber 8 and is located opposite the switch tongue 16 of a microswitch 17. This microswitch 17 is attached in a suitable manner, not illustrated in the drawings, to the axial piston pump 3.

During operation a dynamic pressure drop occurs in the area of the constriction 13 when liquid flows through the constriction. When the pressure line is open and cleaning liquid is being conveyed, a pressure difference, therefore, builds up at the piston 9 and draws the plunger 15 into the control chamber 8, thereby removing it from the switch tongue 16 of the microswitch 17. The microswitch 17 remains unactuated in this position and can connect the electric motor 1 to a voltage source, not illustrated in the drawings, so the electric motor operates normally.

Once the flow in the pressure line is cut off, for example, by closing the delivery line, substantially equal pressures prevail in the chambers 11 and 14, and this results in the piston 9 and with it the plunger 15 being pushed against the microswitch 17. The plunger 15 thus actuates the switch tongue 16 of the microswitch 17, which thereupon cuts off the power supply to the electric motor 1, i.e., this results in the electric motor 1 being switched off.

This switched-off state continues until a pressure difference builds up again in the chambers 11 and 14, which can, for example, be achieved by opening the delivery line.

Beside the plunger 15, a rotatable switching-off element 18 is mounted on the axial piston pump 3. The switching-off element 18 is rotatable from the outside of the high-pressure cleaning apparatus. For this purpose, this switching-off element 18 can be provided with a switch stem, not illustrated in the drawings, which is guided out of the housing 19 of the high-pressure cleaning apparatus towards the outside. The switching-off element 18 carries a projection 20 at the side thereof, which in a first angular position of the switching-off element 18 is removed from the switch tongue 16 of the microswitch 17 (FIG. 2) but in another angular position rests against the switch tongue 16 and thereby actuates the microswitch 17 (FIG. 3), i.e., the microswitch 17 thereby cuts off the power supply to the electric motor 1.

The switching-off element 18 is arranged beside the plunger 15 such that both the switching-off element 18 and the plunger 15 can move the same switch tongue 16 into the switched-off position of the microswitch 17. When the switching-off element 18 moves the microswitch 17 to the switched-off position, the switching-off element 18 is fixed in this switched-off position. This can be done by, for example, an elastic detent device by means of which the rotational movement of the switching-off element 18 takes place in an indexed manner. This detent device is not illustrated in the drawings.

During operation of the high-pressure cleaning apparatus, the operator first switches the switching-off element 18 from the switched-off position (FIG. 3) to the operative position (FIG. 2). This switches the apparatus on, but the electric motor 1 will only start to run when a pressure difference is built up in the chambers 11 and 14, i.e., when the plunger 15 is also moved into the retracted position.

In operation, the microswitch 17 is actuated exclusively by the plunger 15, as the switching-off element 18 acts as switching-on switch and remains switched on. If, however, the user wishes to shut down the apparatus at the end of operation, he can do so in a simple way by means of the switching-off element 18 as it is then sufficient to turn the switching-off element 18 to the switched-off position.

All in all, a single microswitch is thus provided as both main switch and emergency stop switch. It is, therefore, no longer necessary to operate two such switches in succession.

Solely for the sake of completeness, it is pointed out that the plunger 15 can also be moved in a different way for emergency stopping purposes. In the illustrated embodiment, the plunger is actuated by a pressure difference in the pressure line. In principle, it is also possible to provide other switching parameters for actuation of the plunger 15, for example, the plunger could be displaced in a temperature-dependent manner in order to make switching-off possible if the liquid has been heated too strongly.

Other possibilities are also conceivable. It is merely decisive that in addition to the operation-dependent displacement of the plunger or another actuating element of the microswitch 17, an additional possibility for switching off the same switch manually be provided.

In the embodiment of FIGS. 1 to 3, both the actuating element and the switching-off element act on a common switch tongue 16 of the switch.

The embodiment of FIGS. 4 to 6 shows another possibility, whereby the actuating element actuates the switch in dependence upon pressure or flow of the cleaning liquid only when the switching-off element is in a certain position, but not when the switching-off element is in another position.

The high-pressure cleaning apparatus itself can be of the same design as in the embodiment of FIGS. 1 to 3, and identical parts are, therefore, given the same reference numerals.

Differently from the embodiment of FIGS. 1 to 3, in the embodiment of FIGS. 4 to 6 the microswitch 17 is mounted on the high-pressure cleaning apparatus for rotation about an axis of rotation 21. A V-shaped bending spring 22 rests with one arm 23 against the microswitch 17 and with the other arm 24 against the high-pressure cleaning apparatus itself and thereby swivels the microswitch 17 against a stop, which is not illustrated in the drawings. In this position, illustrated in solid lines in FIG. 6, the switch is in its actuation position.

A swivel lever 25 is mounted for swivel movement on the high-pressure cleaning apparatus. One arm 26 of the swivel lever 25 is located opposite a switch member 27 which can be resiliently pressed into the microswitch 17. Against its other arm 28 there rests a plunger 15 which in the same manner as the plunger 15 of the embodiment of FIGS. 1 to 3 is displaceable in dependence upon pressure and/or flow of the liquid to be conveyed, but, in the embodiment shown here in the reverse direction, i.e., in contrast to the embodiment of FIGS. 1 to 3, in this embodiment the switching-off of the motor occurs when the plunger is drawn into the high-pressure cleaning apparatus, i.e., moves away from the swivel lever 25. If, however, the plunger 15 is pushed forwards it swivels the swivel lever 25 and presses it with its arm 26 against the switch member 27. Here it is to be ensured that the bending spring 22 is strong enough to prevent deviation of the microswitch 17.

An eccentric device 30 is mounted on the high-pressure cleaning apparatus for rotation by means of a turning knob 29. In a first position, the eccentric device 30 is removed from the microswitch 17, in the second position, shown in dot-and-dash lines in FIG. 6, it does, however, come to rest against the microswitch 17 and swivels it against the action of the bending spring 22 to such an extent that in each position the swivel lever 25 is made to assume by displacement of the plunger 15, it can no longer reach the switch member 27. Therefore, in this swivelled position of the microswitch 17, the switch member 27 does, in any case, remain unactuated, and this results in the motor permanently remaining switched off.

The turning knob 29 thus forms together with the eccentric device 30 a switching-off element with which the motor can be switched off permanently, whereas in the operating state switching-off of the motor can take place in dependence upon the pressure or the flow of the liquid via the plunger 15 and the swivel lever 25. Here, too, the switching-on and switching-off of the motor take place in dependence upon the pressure or the flow of the liquid, on the one hand, and the switching-on and switching-off of the motor at the beginning and end of the operating cycle via a single microswitch 17.

The same aim is also achieved with the embodiment of FIGS. 7 to 9, but with different structural means. Here, too, the design of the high-pressure cleaning apparatus is essentially the same as in the previous embodiments, and a microswitch 17 is similarly used for switching on and off the motor. Like parts are, therefore, also given the same reference numerals here.

Herein, the microswitch 17 is held firmly on the high-pressure cleaning apparatus. There is mounted on the high-pressure cleaning apparatus immediately beside the microswitch 17 a sleeve-shaped actuating element 31 for axial displacement transversely to the direction of displacement of the switch member 27 of the microswitch 17. To this end, the sleeve-shaped actuating element 31 is surrounded at its upper side and at its underside by a cylindrical guide 32 and 33, respectively, which, in addition to the limited axial displacability of the actuating element 31, also mount it for rotation about its longitudinal axis. A pin 34 of a turning knob 35 arranged on the high-pressure cleaning apparatus projects into the sleeve-shaped actuating element 31. The turning knob 35 forms together with the pin 34 the switching-off element of this arrangement. The pin 34 is connected in an axially freely displaceable and rotationally fixed manner to the sleeve-shaped actuating element 31 so that upon rotation of the turning knob 35, the sleeve-shaped actuating element 31 is also rotated about its axis of rotation.

There is arranged between the end face 36 of the pin 34 and the bottom 37 of the sleeve-shaped actuating element 31 a pressure spring 38 which presses the sleeve-shaped actuating element 31 against a plunger 15 which rests against the underside of the bottom 37 and which is displaceable in the direction of the axis of rotation of the actuating element 31 in dependence upon the pressure or the flow of the liquid being conveyed.

The sleeve-shaped actuating element 31 carries at its circumference a switch cam 39 which extends in the circumferential direction over only a small angular area and which also has a limited extent in the axial direction. The surface of the switch cam 39 which is furthest from the axis of rotation forms a switch surface 40 which continues via an inclined slide surface 41 into the circumferential surface of the sleeve-shaped actuating element 31.

When the switch cam 39 stands directly opposite the switch member 27 of the microswitch 17, the switch cam 39 can be moved by axial displacement of the actuating element 31 to a position in which the switch surface 40 rests on the switch member 27 and presses it into the microswitch 17 (FIG. 7), and to a position in which the switch cam 39 lies beside the switch member 27 and, therefore, does not actuate it (FIG. 8). This movement between the switched-on position and the switched-off position is brought about against the action of the pressure spring 38 by the plunger 15 which moves in dependence upon the pressure or the flow of the liquid. It is thus possible to switch the motor on and off in dependence upon the pressure or the flow of liquid.

This switching of the microswitch 17 is only possible when the switch cam 39 points in the direction towards the microswitch 17. By rotating the turning knob 35, the actuating element 31 can be moved to an angular position in which the switch cam 39 is removed from the microswitch 17 (FIG. 9), and in this position of the actuating element 31, the switch surface 40 of the switch cam 39 can on no account actuate the switch member 27 of the microswitch 17, namely independently of the respective axial position of the sleeve-shaped actuating element 31. Hence, in this angular position of the actuating element 31 it is ensured that the microswitch 17 cannot be actuated. This is the switched-off position of the apparatus.

What is claimed is:

1. High-pressure cleaning apparatus comprising an electric motor, a high-pressure pump driven by said electric motor, and an automatic switching-off means for said electric motor including a switch actuatable by an actuating element moveable in dependence upon the pressure or the flow of the liquid being conveyed by said high-pressure pump, wherein a switching-off element which is manually actuatable on said high-pressure cleaning apparatus is associated with said switch so that in one position of said switching-off element said switch cuts off the power supply to said electric motor independently of the pressure or the flow of the liquid being conveyed, whereas in the other position said switch is actuatable by said actuating element.

2. High-pressure cleaning apparatus as defined in claim 1, wherein said switching-off element is fixable in the switched-off position.

3. High-pressure cleaning apparatus as defined in claim 1, wherein both said actuating element and said switching-off element are moveable against a displaceable switch element of said switch, and said switch element is thereby moved into the switched-off position of said switch.

4. High-pressure cleaning apparatus as defined in claim 2, wherein both said actuating element and said switching-off element are moveable against a displaceable switch element of said switch, and in that said switch element is thereby moved into the switched-off position of said switch.

5. High-pressure cleaning apparatus as defined in claim 3, wherein said switch is a microswitch with a switch arm.

6. High-pressure cleaning apparatus as defined in claim 4, wherein said switch is a microswitch with a switch arm.

7. High-pressure cleaning apparatus as defined in claim 1, wherein said switching-off element moves said switch between two positions, and said actuating element reaches said switch in only one of these two positions for actuation thereof.

8. High-pressure cleaning apparatus as defined in claim 2, wherein said switching-off element moves said switch between two positions, and said actuating element reaches said switch in only one of these two positions for actuation thereof.

9. High-pressure cleaning apparatus as defined in claim 7, wherein said switch is mounted for swivel movement on said high-pressure cleaning apparatus, and said switching-off element swivels said switch between two positions.

10. High-pressure cleaning apparatus as defined in claim 8, wherein said switch is mounted for swivel movement on said high-pressure cleaning apparatus, and said switching-off element swivels said switch between two positions.

11. High-pressure cleaning apparatus as defined in claim 7, wherein said switch is pressed by a spring against said actuating element.

12. High-pressure cleaning apparatus as defined in claim 9, wherein said switch is pressed by a spring against said actuating element.

13. High-pressure cleaning apparatus as defined in claim 1, wherein said switching-off element is a rotatable eccentric device.

14. High-pressure cleaning apparatus as defined in claim 1, wherein said actuating element is a swivel lever which rests against a switch projection of said switch and which is arranged for swivelling by a plunger which is displaceable in dependence upon the pressure or the flow of the liquid being conveyed.

15. High-pressure cleaning apparatus as defined in claim 1, wherein said actuating element carries a switch surface positionable on said switch member of said switch and is displaceable in dependence upon the pressure or the flow of the liquid being conveyed such that in one position said switch surface actuates said switch member, and in another position said switch surface does not actuate said switch member, and said actuating element is additionally displaceable by hand such that said switch surface is positionable on said switch member in one position only.

16. High-pressure cleaning apparatus as defined in claim 2, wherein said actuating element carries a switch surface positionable on said switch member of said switch and is displaceable in dependence upon the pressure or the flow of the liquid being conveyed such that in one position said switch surface actuates said switch member, and in another position said switch surface does not actuate said switch member, and said actuating element is additionally displaceable by hand such that said switch surface is positionable on said switch member in one position only.

17. High-pressure cleaning apparatus as defined in claim 3, characterized in that said actuating element carries a switch surface positionable on said switch member of said switch and is displaceable in dependence upon the pressure or the flow of the liquid being conveyed such that in one position said switch surface actuates said switch member, and in another position said switch surface does not actuate said switch member, and in that said actuating element is additionally displaceable by hand such that said switch surface is positionable on said switch member in one position only.

18. High-pressure cleaning apparatus as defined in claim 5, characterized in that said actuating element carries a switch surface positionable on said switch member of said switch and is displaceable in dependence upon the pressure or the flow of the liquid being conveyed such that in one position said switch surface actuates said switch member, and in an other position said switch surface does not actuate said switch member, and in that said actuating element is additionally displaceable by hand such that said switch surface is positionable on said switch member in one position only.

19. High-pressure cleaning apparatus as defined in claim 15, wherein said actuating element is rotatable about an axis of rotation and displaceable along said axis of rotation in dependence upon the pressure or the flow of the liquid, and carries at its outer circumference a switch surface extending only over a limited circumferential angle and at a distance from said axis of rotation which varies in the axial direction.

20. High-pressure cleaning apparatus as defined in claim 19, wherein for axial displacement of said actuating element a plunger which is displaceable in dependence upon pressure or flow of the liquid rests against said actuating element.

21. High-pressure cleaning apparatus as defined in claim 19, wherein said actuating element is connected in a rotationally fixed and axially freely displaceable manner to a switching-off element in the form of a rotatable member.

22. High-pressure cleaning apparatus as defined in claim 20, wherein said actuating element is connected in a rotationally fixed and axially freely displaceable manner to a switching-off element in the form of a rotatable member.

23. High-pressure cleaning apparatus as defined in claim 21, wherein said actuating element is in the form of a sleeve into which there projects a pin of said switching-off element, a plunger displaceable in dependence upon pressure or flow of the liquid rests against the bottom of said sleeve, and there is arranged between said switching-off element and said sleeve a spring which presses said sleeve against said plunger.

24. High-pressure cleaning apparatus as defined in claim 22, wherein said actuating element is in the form of a sleeve into which there projects a pin of said switching-off element, a plunger displaceable in dependence upon pressure or flow of the liquid rests against the bottom of said sleeve, and there is arranged between said switching-off element and said sleeve a spring which presses said sleeve against said plunger.

* * * * *